United States Patent [19]

Meshulam

[11] Patent Number: 4,549,758

[45] Date of Patent: Oct. 29, 1985

[54] GOLF BALL RETRIEVING APPARATUS

[76] Inventor: Eli Meshulam, 271 S. Citrus Ave., Los Angeles, Calif. 90036

[21] Appl. No.: 582,024

[22] Filed: Feb. 21, 1984

[51] Int. Cl.[4] ..... A63B 47/02

[52] U.S. Cl. ..... 294/19.2; 294/66.1

[58] Field of Search ..... 294/19 R, 19 A, 66 R, 294/86.1, 93, 97; 15/1.7; 56/400.04, 400.11, 400.19; 273/32 F, 162 E

[56] References Cited

U.S. PATENT DOCUMENTS

| | | | |
|---|---|---|---|
| 2,270,632 | 1/1942 | Hasty | 294/19 A |
| 2,586,003 | 2/1952 | Caslor | 294/93 X |
| 2,623,769 | 12/1952 | Kegley | 294/19 A |
| 2,738,214 | 3/1956 | Zimmers | 294/19 A |
| 3,442,544 | 5/1969 | Faber | 294/19 A |
| 3,926,464 | 12/1975 | Alexander | 294/19 A |
| 4,216,831 | 8/1980 | Ritchie | 294/19 A X |

FOREIGN PATENT DOCUMENTS

| | | | |
|---|---|---|---|
| 355381 | 8/1931 | United Kingdom | 294/19 A |

*Primary Examiner*—Johnny D. Cherry
*Attorney, Agent, or Firm*—James E. Brunton

[57] ABSTRACT

A golf ball retrieving device for use in retrieving golf balls from water hazards. The device includes an articulated retrieving head portion adapted to be moved along the bottom of the water hazard. The retrieving head includes an apertured body portion and pivotally interconnected apertured wing-like elements which are uniquely configured so that as the retrieving head moves along the bottom of the water hazard the water in the hazard will flow past the device in a manner tending to sweep the lost golf ball inwardly along the wing-like elements toward the ball retaining compartments of the body portion.

11 Claims, 3 Drawing Figures

GOLF BALL RETRIEVING APPARATUS

BACKGROUND OF THE INVENTION

1. Field of the Invention

The present invention relates generally to ball retrieving devices. More particularly, the invention concerns a liquid flow assisted golf ball retrieving device.

2. Discussion of the Prior Art

Planned hazards of a typical golf course include water hazards. Accordingly, during play, golf balls frequently land in the water harzards and, unless the ball comes to rest near the edge of the hazard, it cannot be readily retrieved.

Various types of golf ball retrieving devices have been suggested in the past. Several such devices include extendable handles and a ball container with an opening through which the ball can pass. Exemplary of such devices are those disclosed in U.S. Pat. Nos. 3,029,097; 3,046,044 and 4,046,413.

Most of the prior art devices work reasonably well if the water in the water hazard is clear and the ball can be seen by the player. However, even in such ideal situations some of the prior art devices have proven to be cumbersome and difficult to use. Where the water in the hazard is not clear and the ball cannot be seen, most prior art devices are virtually useless because, if the ball cannot be seen, the device cannot be manipulated so as to capture the ball. Some devices, which are little more than rakes, have been suggested for use in the "blind" retrieval of golf balls. However, such devices do not generally work well in actual practice because, as the ball and rake move through the water, the ball tends to roll or float above or around the retriever head.

The apparatus of the present invention uniquely solves the drawbacks of the prior art devices by providing a novel arrangement whereby as the retrieving head moves through the hazard, the water itself is used to aid in the capture of the ball.

SUMMARY OF THE INVENTION

It is an object of the present invention to provide a golf ball retrieving device which is well suited for use in retrieving golf balls from water hazards in which the water is either colored or is murky so that the ball cannot be seen.

More particularly, an object of the invention is to provide such a golf ball retriever which is uniquely configured so that as the articulated retrieving head thereof is moved along the bottom of the hazard the water in the hazard will flow past the device in a manner tending to sweep the lost golf ball inwardly along outwardly extending curved wing-like elements toward the ball retaining compartment.

Another object of the invention is to provide a device of the character described which is lightweight, compact and particularly suited for carrying in the conventional golf bag of the player.

A further object of the invention is to provide a device as described in the preceding paragraphs which has a minimum number of moving parts and is easy to use and permits fast and expeditious retrieval of lost golf balls.

Still another object of the invention is to provide a golf ball retriever which is inexpensive to manufacture and one which can be manufactured in high production volumes.

DESCRIPTION OF THE INVENTION

Figure 1:
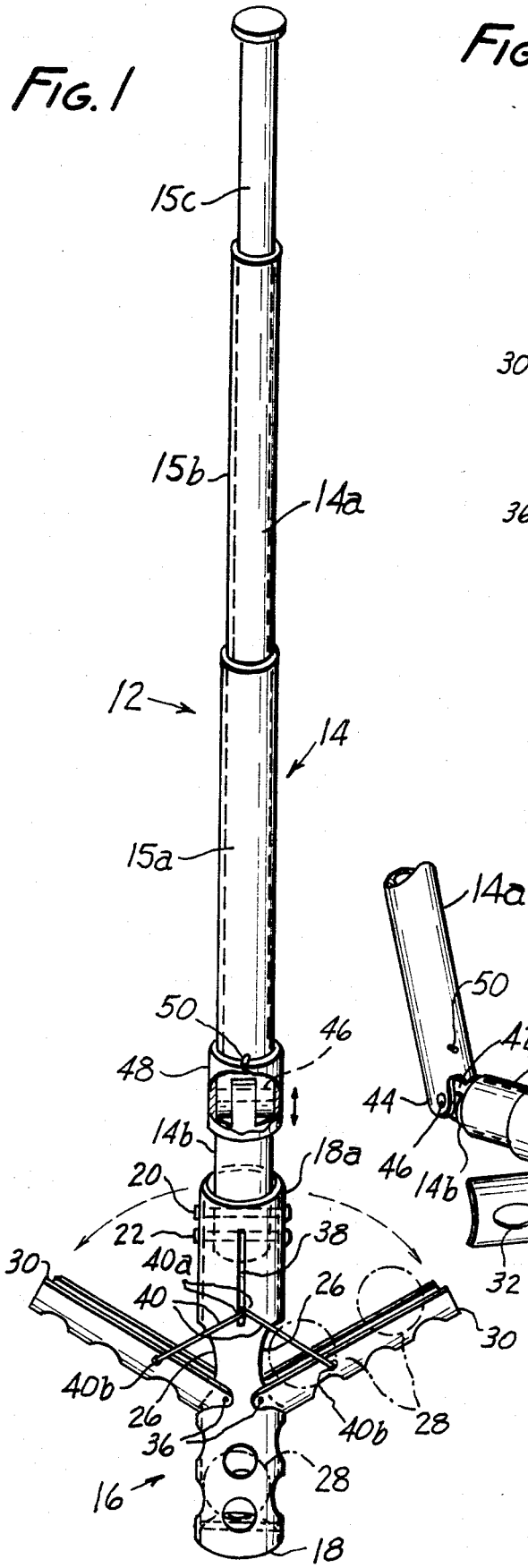
FIG. 1 is a generally perspective, front view of the golf ball retrieving apparatus of the present invention.
Figure 3:
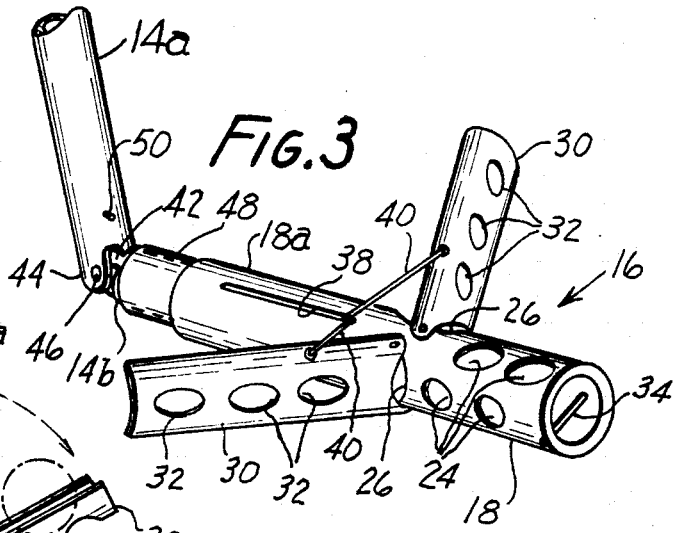
FIG. 3 is a fragmentary perspective view of the lower portion of the apparatus illustrating the pivotal interconnection between the upper and lower portions of the handle and showing the apparatus in a deployed, operational configuration.

Referring to the drawings, and particularly to FIGS. 1 and 3, the Golf Ball Retrieving Apparatus of the invention generally designated by the numeral 12 comprises an elongated handle 14 having an upper portion 14*a*, including telescoping sections 15*a*, 15*b* and 15*c*, and a pivotally interconnected lower portion 14*b*. Affixed to lower portion 14*b* is a golf ball engaging means generally designated by the numeral 16 for retrieving and entrapping golf balls.

The golf ball engaging means 16 of this embodiment of the invention comprises a hollow body 18 connected at its inboard end 18*a* to the lower handle portion 14*b* by means of suitable fasteners shown here as coupler pins 20 and 22. The outboard, or lower, portion of body 18 is provided with a plurality of spaced apart apertures 24 so as to permit the flow of fluid through the apertures and then outwardly through the open lower end of hollow body portion 18. Formed intermediate the ends of hollow body portion 18 is a pair of side openings 26 of a diameter slightly larger than the diameter of a golf ball.

Pivotally connected to body portion 18, proximate side openings 26 is a pair of outwardly extending guide means for guiding the travel of golf balls (numeral 28 in FIG. 1) in a direction toward the side openings 26. In the embodiment of the invention shown in the drawings, the guide means is provided in the form of a pair of angularly outwardly extending, curved, wing-like members 30, which members are provided with a plurality of apertures 32 along their length.

Figure 2:
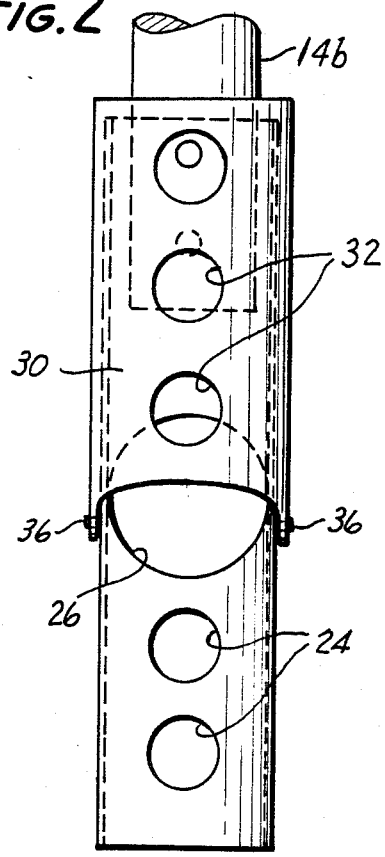
FIG. 2 is an enlarged fragmentary view of the lower portion of the apparatus shown as it appears while in a stowed configuration.

As best seen by referring to FIG. 2, when the apparatus is in use, the lower portion of the apparatus, including the golf ball engaging means, can be articulated relative to the handle 14 so that it can move along the bottom of the water hazard. As the apparatus moves through the water along the bottom of the water hazard, water will tend to flow through the openings 32 in the outwardly extending wing-like portions and through the apertures 24 in the body portion. This flow of water through the device will tend to urge any golf balls in the vicinity of the device to flow toward the device and onto the curved outwardly extending wing-like portions 30. The golf balls 28 will be captured by the curved wing-like portions and, as a result of their angular orientation with the body portion 18, will move inwardly through side openings 26 and into the lower portion of the housing 18. Of course, the currents generated as the device moves through the water will also aid in urging the balls toward the hollow body 18. To retain the balls within the housing 18, the open end thereof 18 is blocked by a transversely extending pin 34.

Referring now to both FIGS. 1 and 2, the wing-like members 30 are pivotally connected to body portion 18 by pivot pins 36 so that the members can be moved from the deployed position shown in FIG. 1 into the stowed position shown in FIG. 2 wherein they overlay portions of the body 18. As shown in FIG. 1, portion 18*a* of body 18 is provided with a longitudinally extending slot 38. This slot is adapted to slidably receive the first end portions 40*a* of a pair of struts 40. The second end portions 40*b* of the struts 40 are pivotally connected to the angularly extending wing-like members 30 intermediate their ends. With this construction, struts 40 tend to guide the deployment of the wing-like members and to restrict the extent of pivotal movement of the members with respect to the pivot pins 36. As the wing-like portions are moved from their deployed position into their stowed position, the first end portions 40*a* of the struts will be guided upwardly by slot 38 so that the wing-like members 30 can move freely into their stowed configuration as illustrated in FIG. 2.

Turning now to FIGS. 1 and 3, the lower portion 14*b* of the handle is provided with an outwardly extending tenon-like segment 42 which is closely received within a yoke-like portion 44 formed at the lower extremity of upper handle portion 14*a*. A pivot pin 46 extends through the yoke portion and tenon portions 44 and 42 respectively so that the upper and lower handle portions can be moved pivotally relative to one another. As previously mentioned, it is necessary that the lower handle portion, along with the ball engaging means articulate with respect to the upper handle portion 14*a* so that the ball engaging means can move smoothly along the bottom of the water hazard. To maintain the upper and lower portions of the handle in axial alignment during storage and transport of the apparatus, locking means are provided for locking the upper and lower portions of the elongated handle in an axially aligned orientation. In the form of the invention shown in the drawings, this locking means comprises a sleeve member 48 which is closely received over handle 14 so that it can be slidably moved to a position wherein it encapsulates the pivotal interconnection between the upper and lower handle portions and prevents pivotal movement therebetween. To maintain the sleeve 48 in close proxmity with the pivot area, a stop pin 50 is provided in the upper handle portion 14*a* at a location proximate the pivotal interconnection of the parts. With this construction, when the sleeve 48 is in the upward position shown in FIG. 1, the upper and lower handle portion will be maintained in coaxial alignment. However, when the sleeve 48 is moved downwardly to the position shown in FIG. 3, the upper and lower handle portions of the device are free to move pivotally relative to one another to enable the ball engaging means to smooth travel along the bottom of the water hazard.

To facilitate stowing of the device, upper handle portion 14*a* is constructed in the three previously identified, frictionally engaged telescoping sections 15*a*, 15*b* and 15*c*. With this construction, the handle 14 can be telescopically extended in the manner shown in FIG. 1, or when the apparatus is to be stowed in the golf bag, the sections 15*a*, 15*b* and 15*c* can be telescoped together to substantially shorten the overall length of the handle 14 thereby facilitating its storage and transport in the golf bag.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A golf ball retrieving apparatus for retrieving golf balls from water hazards, comprising:

(a) an elongated handle having an upper portion and a lower portion; and (b) a ball engaging means for retrieving and entrapping the golf balls, said means comprising:

(i) a hollow body connected to said lower portion of said handle, said body having opposed side openings adapted to receive golf balls therethrough for entrapment within said body and a plurality of smaller spaced apart apertures adapted to permit the flow of fluid therethrough; and (ii) a pair of outwardly extending guide means connected to said hollow body for guiding the travel of golf balls in a direction toward said side openings in said body, said means having a plurality of spaced apart apertures adapted to permit the flow of liquid therethrough.

2. A golf ball retrieving apparatus as defined in claim 1 in which said guide means comprises a pair of angularly outwardly extending wing-like members connected to said hollow body proximate said side openings.

3. A golf ball retrieving apparatus as defined in claim 2 in which said wing-like members are pivotally connected to said hollow body and are movable from a first stowed position wherein they overlay portions of said hollow body to a second deployed position wherein they extend angularly outwardly from said hollow body.

4. A golf ball retrieving apparatus as defined in claim 3 in which said hollow body includes a lower chamber disposed below said side openings for removably entrapping at least one golf ball.

5. A golf ball retrieving apparatus as defined in claim 1 in which said upper and lower portions of said elongated handle are pivotally interconnected.

6. A golf ball retrieving apparatus as defined in claim 1 in which said upper portion of said elongated handle comprises a plurality of frictionally engaged telescoping sections.

7. A golf ball retrieving apparatus as defined in claim 6 including locking means for locking said upper and lower portions of said elongated handle in an axially aligned orientation.

8. A golf ball retrieving apparatus as defined in claim 7 in which said locking means comprises a sleeve member slidably carried by said elongated handle.

9. A golf ball retrieving apparatus for retrieving golf balls from water hazards, comprising:

(a) an elongated handle having a pivotally interconnected upper portion and lower portion; and (b) a ball engaging means for retrieving and entrapping the golf balls, said means comprising:

(i) a holow body connected to said lower portion of said handle, said body having opposed side openings adapted to receive golf balls therethrough for entrapment within said body and a plurality of smaller spaced apart apertures adapted to permit the flow of fluid therethrough; and (ii) a pair of angularly outwardly extending curved, wing-like members pivotally connected to said hollow body for guiding the travel of golf balls in a direction toward said side openings in said body, said members being movable from a first stowed position wherein they overlay portions of said hollow body to a second deployed position wherein they extend angularly outwardly from said hollow body, said members having a plurality of spaced apart apertures along their length adapted to permit the flow of liquid therethrough.

10. A golf ball retrieving apparatus as defined in claim 9 in which said upper portion of said elongated handle comprises a plurality of frictionally engaged telescoping sections.

11. A golf ball retrieving apparatus as defined in claim 10 including locking means for locking said upper and lower portions of said elongated handle in an axially aligned orientation, said locking means comprising a sleeve member slidably carried by said elongated handle.

* * * * *